United States Patent [19]

Bliss

[11] 4,098,151

[45] Jul. 4, 1978

[54] POWERED WRENCH

[76] Inventor: Gary F. Bliss, 2307 Union Ave., Wesleyville, Pa. 16510

[21] Appl. No.: 825,303

[22] Filed: Aug. 17, 1977

[51] Int. Cl.[2] ..... B25B 17/00

[52] U.S. Cl. ..... 81/57.3

[58] Field of Search ..... 81/57.3, 57

[56] References Cited

U.S. PATENT DOCUMENTS

| | | | |
|---|---|---|---|
| 1,263,435 | 4/1918 | Klingbiel | 81/57.3 |
| 1,356,555 | 10/1920 | Oringderff | 81/57.3 |
| 2,746,331 | 5/1956 | Andersen | 81/57.3 |
| 3,564,953 | 2/1971 | Able | 81/57.3 |

*Primary Examiner*—James L. Jones, Jr.
*Attorney, Agent, or Firm*—Charles L. Lovercheck

[57] ABSTRACT

A wrench for rotating a non-circular part on a continuous shaft as tightening the brake on a locomotive. The wrench is made up of a gear box and socket guide containing a two-piece socket gear that can be placed around the part to be rotated. A socket drive gear connected through a power drive insert is provided, and the socket gear can be rotated by a wrench connected to the power drive insert, thereby transmitting power through the socket drive gear to the article being tightened.

10 Claims, 6 Drawing Figures

POWERED WRENCH

GENERAL STATEMENT OF THE INVENTION

The wrench disclosed herein was designed to replace an open-end wrench or other tools used for adjusting enclosed shafts. The operator of the tool will be able to do his job faster and with greater safety than with preceeding tools. The tool will not slip off the article being rotated like an open-end wrench might, and the operator's hands will be clear of the work area. The tool may be connected to bolts, nuts and adjusting rods of any size, even when the nut is on a bolt attached at both ends. The tool can be operated with a ratchet wrench, an impact wrench, or any suitable wrench. The tool may also be equipped with a built-in power source, such as an electric motor or the like.

OBJECTS OF THE INVENTION

It is an object of the invention to provide an improved wrench.

Another object of the invention is to provide an improved wrench for rotating a non-circular member on a continuous rod or shaft.

Another object of the invention is to provide a wrench that is simple in construction, economical to manufacture and simple and efficient to use.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
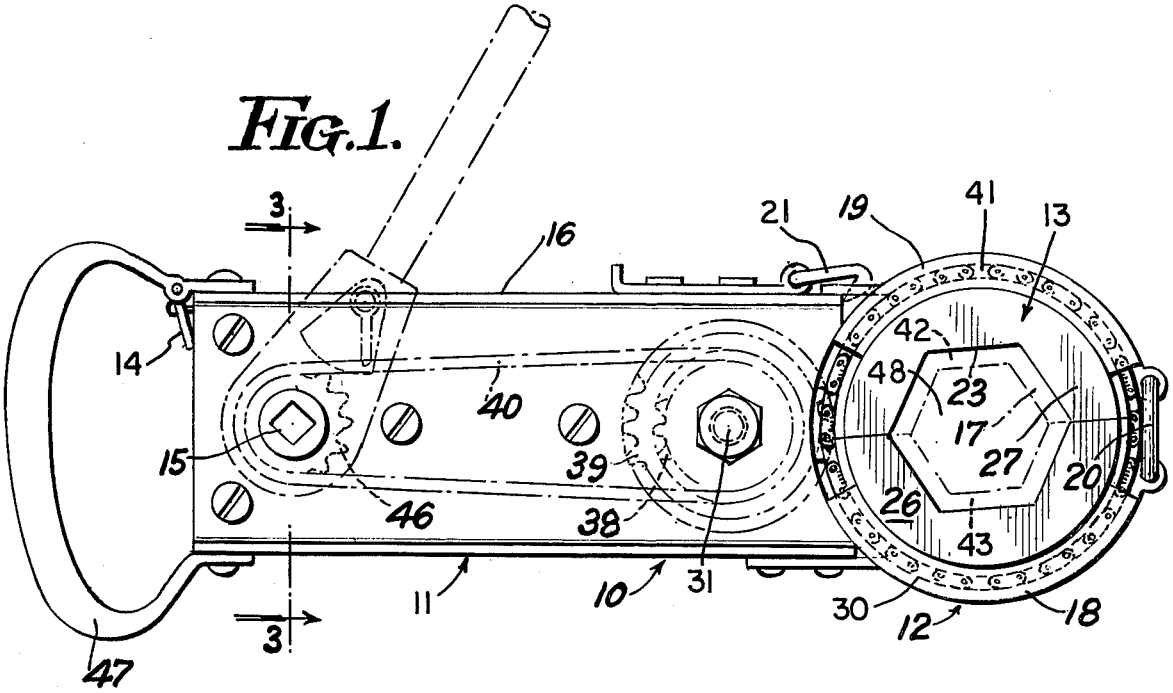
FIG. 1 is a side view of the wrench according to the invention.
Figure 2:
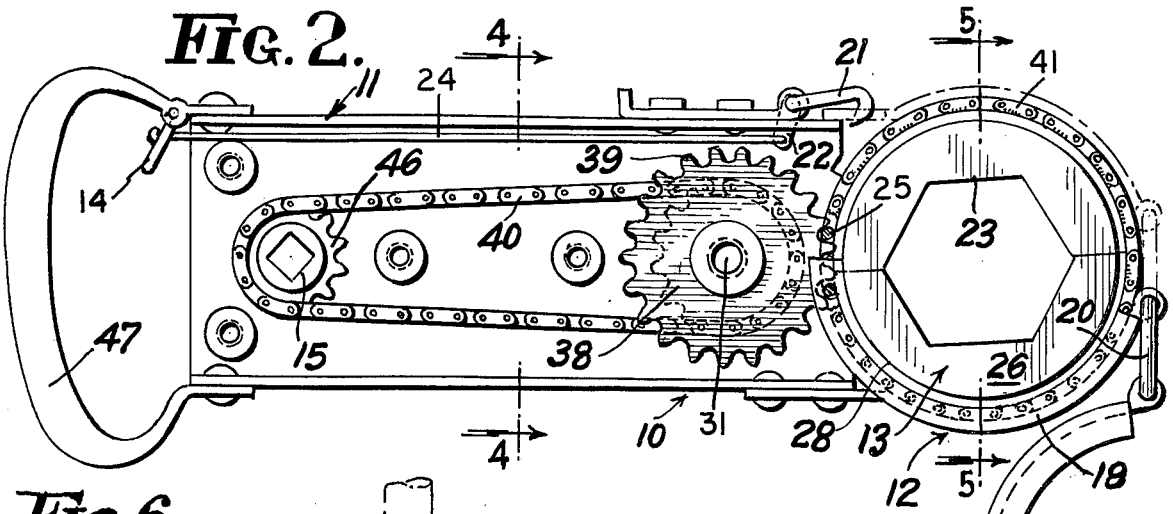
FIG. 2 is a view of the socket guide in a partly open position.
Figure 6:
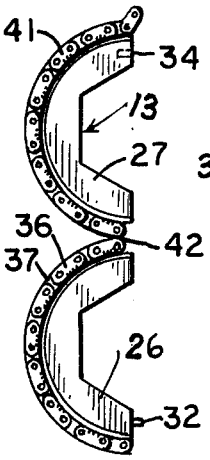
FIG. 6 is a side view of the reducer insert shown in open position.
Figure 3:
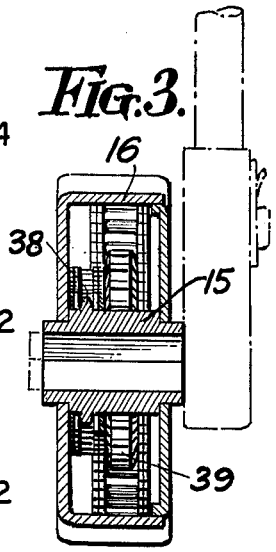
FIG. 3 is an end view of the socket gear taken from Line 3—3 of FIG. 1.
Figure 4:
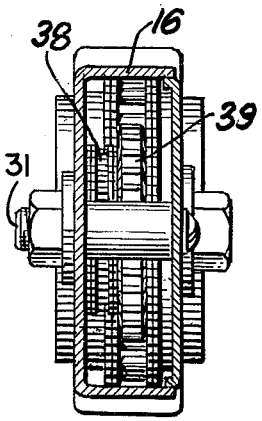
FIG. 4 is an end view of the socket guide taken from Line 4—4 of FIG. 2.
Figure 5:
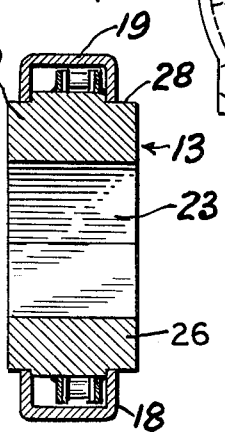
FIG. 5 is an end view of the reducer insert taken on Line 5—5 of FIG. 2.
Figure 5:
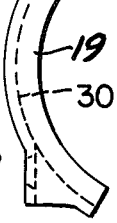

Now, with more particular reference to the drawings, the wrench is indicated generally at 10 having the elongated body or gear box 11, which functions as a handle. The socket guide 12 is integrally connected to the gear box 11, and the socket gear 39 is located in the gear box 11. The socket drive gear 38 is rotatably supported in the gear box or body 11 and driving means 15 is rotatably supported in the gear box at the opposite end thereof from the socket drive gear 38. The driving means 15 extends laterally from the side of the wrench and may have a wrench attached thereto, such as an impact wrench. The driving means 15 turns the drive gear 46 which drives the drive chain 40. The drive chain 40 rotates the socket drive gear 38. The socket drive gear 38 is integrally connected to the socket gear

39. When the socket gear 39 is rotated it engages detents 25 on the socket chain 41. The socket chain 41 is welded around the circumference of the socket 13. When the detents 25 are engaged by the socket gear 39, the socket 13 is rotated. The socket guide 12 has upper hinged part 19 which is hinged to the lower part 18 by a link 20 and a latch 21 swingably connects the upper part 19 to the upper part 16 of the bear box 11 when the wrench is in position for use. A socket guide release 24 is operated from the end adjacent handle 47 by lever 14. The lever 14 pushes or pulls the socket guide release 24 which engages the bell crank 22. The bell crank 22 is rigidly attached to the latch 21. Thus, by moving the lever 14, the latch 21 may be engaged or disengaged.

The socket 13 is made up of socket halves 26 and 27 which are hinged together at 42. The socket gear 13 has a non-circular opening 23 to accommodate a work piece. The size of the opening 23 may be changed to accommodate different sized work pieces by placing reducer inserts 17 in the opening 23 in a manner familiar to those skilled in the art. The reducer insert 17 is divided into two parts 43 and 44 and together the two parts have a non-circular outside surface which fits in the opening 23 and a non-circular opening 48 to receive a work piece to be rotated.

The socket 13 is made up of the socket halves 26 and 27 which are hinged together at 42. The socket 13 has laterally extending, cylindrical shoulders 28 and 29, which form journals which rotate in a sleeve bearing surface 30 in the socket guide 12.

The socket half 26 has locating pins 32 that are received in the openings 34 in the other socket half 27.

The socket gear 13 has a socket chain 41 made up of chain links 36 and 37 that surrounds the two socket halves 26 and 27 of the socket 13 and these sections of chain are welded in place and form a continuous chain of links around the socket 13 when the socket is in place in the position shown in FIG. 1.

When the wrench is to be used, the operator will operate the lever 14 to open latch 21 and allow the upper part 19 of the socket guide 12 to swing open. He will then open the socket 13 and select the proper insert 17 and place it in the socket 13. He will then close the socket and the upper part 19 around the work piece, to the position shown in FIG. 1, close latch 21, attach the proper wrench to the driving means 15 and proceed to rotate the work piece through chain 40, socket drive gear 38, and socket gear 39 which turns on axle 31.

The foregoing specification sets forth the invention in its preferred, practical forms but the structure shown is capable of modification within a range of equivalents without departing from the invention which is to be understood is broadly novel as is commensurate with the appended claims.

The embodiment of the invention in which an exclusive property or privilege is claimed are defined as follows:

1. A wrench comprising,
a body,
a guide supported on the body,
a socket rotatably supported on the guide,
a drive gear supported in the said body,
drive means supported adjacent said drive gear,
a socket drive gear rotatably supported in said body adjacent said guide,
a drive chain engaging said drive gear and said socket drive gear, a socket gear rigidly attached to said socket drive gear, a socket chain fixed to the outer periphery of said socket, said socket having a non-circular opening therein, said socket comprising a first part and a second part, teeth on said socket gear engage said socket chain around said socket whereby when the driving means rotates the drive gear, the drive chain moves revolving the socket drive gear which turns the socket gear which rotates the socket.

2. The combination recited in claim 1 wherein said guide has a hinged part and a fixed part.

3. The combination recited in claim 1 wherein said guide has a first part fixed to said body and a second part hinged to said fixed part and means to latch said second part in position providing a space rotatably receiving said socket.

4. The combination recited in claim 1 wherein a guide release member is supported on said body and connected to latch means on said body for holding said second part of said socket guide in position.

5. The combination recited in claim 2 wherein said second part of said guide is connected to said first part by means of a link.

6. The combination recited in claim 1 wherein said socket has a generally cylindrical shoulder extending outwardly from each opposite side of said gear, said shoulder being rotatably received in bearing surfaces on said guide.

7. The combination recited in claim 1 wherein inserts are placed in said non-circular opening of said socket to adjust the size of said non-circular opening.

8. The combination recited in claim 1 wherein said first part of said socket has a locating pin and said second part has an opening for said locating pin.

9. The combination recited in claim 1 wherein said drive gear has a means thereon for receiving an impact wrench.

10. The combination recited in claim 1 wherein said body has a handle fixed to the end thereof opposite said guide.

* * * * *